US009951760B2

(12) United States Patent
Ruiz Martinez

(10) Patent No.: US 9,951,760 B2
(45) Date of Patent: Apr. 24, 2018

(54) DRIVE MECHANISM FOR ROTARY COMPRESSORS OR PUMPS

(71) Applicant: Francisco Javier Ruiz Martinez, Baleares (ES)

(72) Inventor: Francisco Javier Ruiz Martinez, Baleares (ES)

( * ) Notice: Subject to any disclaimer, the term of this patent is extended or adjusted under 35 U.S.C. 154(b) by 547 days.

(21) Appl. No.: 14/394,019

(22) PCT Filed: Mar. 15, 2013

(86) PCT No.: PCT/ES2013/070172

§ 371 (c)(1),
(2) Date: Oct. 10, 2014

(87) PCT Pub. No.: WO2013/153245

PCT Pub. Date: Oct. 17, 2013

(65) Prior Publication Data

US 2015/0078932 A1 Mar. 19, 2015

(30) Foreign Application Priority Data

Apr. 10, 2012 (ES) ..... 201230532

(51) Int. Cl.

| | |
|---|---|
| ***F04B 35/01*** | (2006.01) |
| ***F04B 9/04*** | (2006.01) |
| ***F04B 39/00*** | (2006.01) |
| ***F04B 53/00*** | (2006.01) |
| ***F01B 1/08*** | (2006.01) |
| ***F01B 9/06*** | (2006.01) |
| ***F04B 1/02*** | (2006.01) |
| ***F04B 27/00*** | (2006.01) |

(52) U.S. Cl.
CPC ..... *F04B 35/01* (2013.01); *F01B 1/08* (2013.01); *F01B 9/06* (2013.01); *F04B 1/02* (2013.01); *F04B 9/04* (2013.01); *F04B 9/047* (2013.01); *F04B 27/005* (2013.01); *F04B 39/0094* (2013.01); *F04B 53/006* (2013.01)

(58) Field of Classification Search
CPC .... F04B 1/02; F04B 9/04; F04B 9/047; F04B 27/005; F04B 35/01; F04B 39/0094; F04B 53/006
USPC ..... 92/138
See application file for complete search history.

(56) References Cited

U.S. PATENT DOCUMENTS

| | | | | |
|---|---|---|---|---|
| 7,328,682 | B2 * | 2/2008 | Fisher | F01B 9/023 123/197.4 |
| 7,552,707 | B2 * | 6/2009 | Fisher | F01B 9/023 123/197.4 |
| 2009/0155107 | A1 * | 6/2009 | Ruiz Martinez | B60K 6/12 417/516 |

* cited by examiner

*Primary Examiner* — Thomas E Lazo
(74) *Attorney, Agent, or Firm* — Brown & Michaels, PC

(57) ABSTRACT

Drive mechanism for rotary compressor or pump that consists of a casing (1) formed by two housings where two diametrically opposed cylinders (2), where the pistons (3) slide, are coupled, each of the pistons being attached by means of a connecting rod (5) to the end of a lever (4) which pivots about the other end (9), located on the periphery of the casing (1) and is forced by the journal of a crankshaft (6) that slides along a slot (7), made in the central area of this lever, and is operated by an external mechanism, the whole assembly being able to rotate about the crankshaft, which remains static and coupled to the structure or support and generates a linear piston cycle at each revolution.

1 Claim, 6 Drawing Sheets

DRIVE MECHANISM FOR ROTARY COMPRESSORS OR PUMPS

BACKGROUND OF THE INVENTION

1. Field of the Invention

The present invention relates to a mechanism in the field of rotary compressors and pumps.

2. State of the Art

Nowadays, there are some mechanisms having similar systems to the one proposed that have not yet been commercialized.

These compressors having a design with tangential cylinders comprise a casing with a crank in the center and two or more two-armed structured levers with a turn axis inside, which engages a shaft that is radially located at the casing.

At the outer arm of this lever, the piston is connected via a connecting rod whereas at the inner arm a slot has been made in which the crank stem slides, with the whole assembly rotating with all elements coupled thereto about the crank shaft, which remains static after being anchored to the structure.

This arrangement causes the lever, which is driven by its shaft, to pivot about the latter forced by the eccentric stem of the crank when rotating the assembly, thereby producing an oscillation per rotation of the assembly, which linearly moves the piston that is attached to the outer arm.

In this structure in which a force is applied on the fulcrum (turn axis), the inner arm acts as the power arm and behaves as a lever of third order that is inefficient. In addition, when the crank stem moves along the slot, the power arm distance increases or decreases largely, thus making fast-changing torques causing the assembly instability.

As is well known, the lever is a device used for many centuries and in particular, the one proposed in this mechanical system, with one of its so saying "floating" points, is being used extensively in the textile and food industry and in many types of machines, from which it is obvious that no one attempts to patent a lever having said characteristics, but a mechanical system enabling the production of a rotary assembly to transform a circular movement into a linear movement through the interaction of this with a crankshaft.

For a couple of decades, a mechanism having the aforementioned characteristics has been tried to be developed by the same author, initially based on the idea of using an assembly that rotates about a crank and having a slotted lever that pivots about an axis located in the central area thereof. The force is applied on this axis and the journal of the crank slides along the slotted area located in the inner arm, which acts as a fulcrum. In this way, as the assembly rotates and the journal of the crank slides along the grooved area, since it remains static anchored to the structure supporting the assembly, it produces a tilting movement on the lever that is transmitted to the resistance arm and from this to a piston by means of a connecting rod and a piston, thus causing the linear movement thereof along a cylinder tangentially located. This lever is classified as of third order (the force is applied at the center) and, as it is known, it does not produce any advantage, but the project was continued with the understanding that the benefits obtained by the rotation would be important.

Several prototypes have been developed in principle with a crank (crankshaft with only one journal) and subsequently with a crankshaft with two and three journals for machines of two or three cylinders in an attempt to statically balance the assembly. After several prototypes, the project was abandoned because the design of the proposed mechanism did not produce any benefit and the vibrations it originated (apparently because the sliding of the fulcrum along the inner groove continuously changes the length of the power arm) prevented the rotation at relatively low speeds. This information relates exclusively to rotary piston compressors; European Patent EP1749685 and Spanish Patents ES2065801 and ES2263331, and the inventor is not aware of others having these features.

After several attempts to solve these problems, an innovation has been found that not only overcomes this impediment, but also provides stability to the mechanism, which makes it highly efficient. This new mechanism is based on an assembly, consisting of a unit comprising two housings, wherein a lever anchored by a shaft, about which it pivots and which is arranged at one of its ends, is located, which has a slotted central area and also rotates about a crankshaft. By rotating the unit, the force applied on the shaft about which the lever pivots and as it slides along the grooved area on the crank journal, which acts as a fulcrum and which is stationary and anchored to the structure or support of the assembly, produces an oscillation of the lever that results in a linear movement of the other end and which, by means of a connecting rod, is applied to a piston sliding into a cylinder radially located in the assembly.

As clearly seen, the fundamental difference between the two systems is that in the first the crankshaft actuates on the power arm by changing its length and causing the tilting movement of the lever whereas the resistance arm does not change, thereby and depending on the position in the rotation during a sector, it is greater than the power arm so, according to this design, the lever does not produce any benefit by acting as a third-order lever and causes vibrations which make the project unfeasible. In the system that is currently proposed, the crank acts as a fulcrum and at the same time it causes the oscillation of the lever during the rotation and changes the relationship between the power-resistance arms, increasing the first one during the working stroke and decreasing it in the suction stroke (this new feature allows to greatly improve the lever arm and the piston stroke with small variations in the diameter of the crankshaft) and the lever acts as a first-order one in the first case and as a second-order one in the following case, thus significantly improving the efficiency of the mechanism while the vibrations are eliminated.

This mechanism, with the same design, can be used as a vacuum pump. For this purpose, the rotation is inverted in order to take advantage of the maximum length of the lever arm during the operating step. Also the suction and discharge inlet and outlet are invested in such a way that the aspiration is performed by the duct of the front shaft and the rotary valve and the gas is directly expelled outside through the discharge valve of the cylinder head.

As previously mentioned, this device works by acting on a first-order lever, wherein the crankshaft is the fulcrum, and the eccentricity of the journals results in linear movement of the piston, since the entire assembly (casing, cylinders, rods, pistons, cylinder heads, recovery pumps and levers) rotates about said crankshaft, i.e., it must remain static so that the entire assembly works for the purpose it is intended to be used. This feature means that if we act by releasing and locking the crankshaft at will, it allows the mechanism to rotate freely on a bed without creating more strength than that of the rotation when it is released, or to produce compression or vacuum energy as required when it is locked. Thus, we can reduce the workload during the start and if we couple the drive mechanism to the drive axle of a vehicle and provide it with a clutch or brake, which can act to lock the crankshaft when required, it can be used to assist braking and recover energy during the same.

SUMMARY OF THE INVENTION

The present invention relates to improvements introduced in the drive mechanism of rotary compressors with tangential pistons aimed at achieving an efficient mechanism and eliminating vibration problems that make the above mechanisms are inoperative.

DETAILED DESCRIPTION AND PREFERRED EMBODIMENT OF THE INVENTION

This new design of compressor comprises two housings making up the casing (1), where the cylinders (2), in which the pistons (3) slide, are coupled, the latter being attached to the end of the lever (4) by means of the connecting rod (5), wherein inside said lever a slot (7) has been machined, through which the crankshaft journals (6) slide, and the other end pivots about the shaft (9) located in the peripheral area of the casing. In the cylinder head (8) the suction and exhaust valves for the operation of the compressor or vacuum pump have been arranged. Aspiration is performed directly from the cylinder head through a filter attached to the inlet thereof and the gas is discharged through a duct connecting the outlet of the cylinder head to the front axle (10) and from there, through a rotating seal to the outside for its subsequent use or storage.

The assembly can be housed in a frame and rotate on bearings that are attached both to the front axle (10) and to the pulley supporting shaft (14). The crankshaft can be fixed directly to the frame or supporting structure of the assembly by any means that prevent its rotation or through a brake or clutch (13), in such a way that it is possible to lock or release it at will. (FIG. 2A)

The lubrication proposed for this mechanism derives from an external reservoir by means of a pressurized system and the recovery is made by means of a impeller suction pump (12) actuated by the lever (4), with both the entrance and the recovery of the used agent being made through the crankshaft.

DESCRIPTION OF DRAWINGS

In order to complement the description being made and to assist to a better understanding of the features of the invention, a set of drawings is attached to the present specification as an integral part thereof, wherein in an illustrative and not limiting way, the following has been represented.

Figure 1:
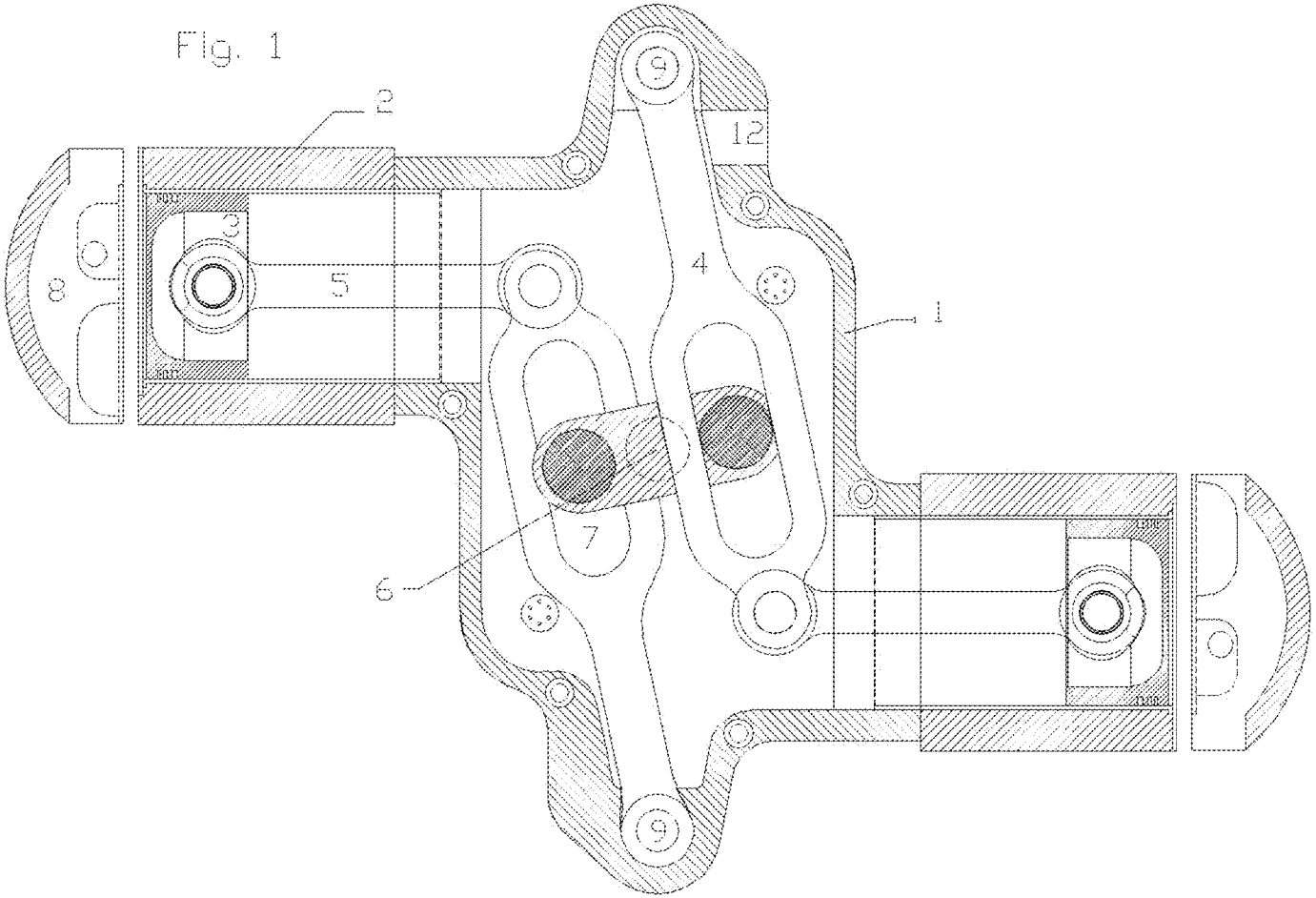
FIG. 1.—shows a plan view of the arrangement of the different elements in the casing.
Figure 2:
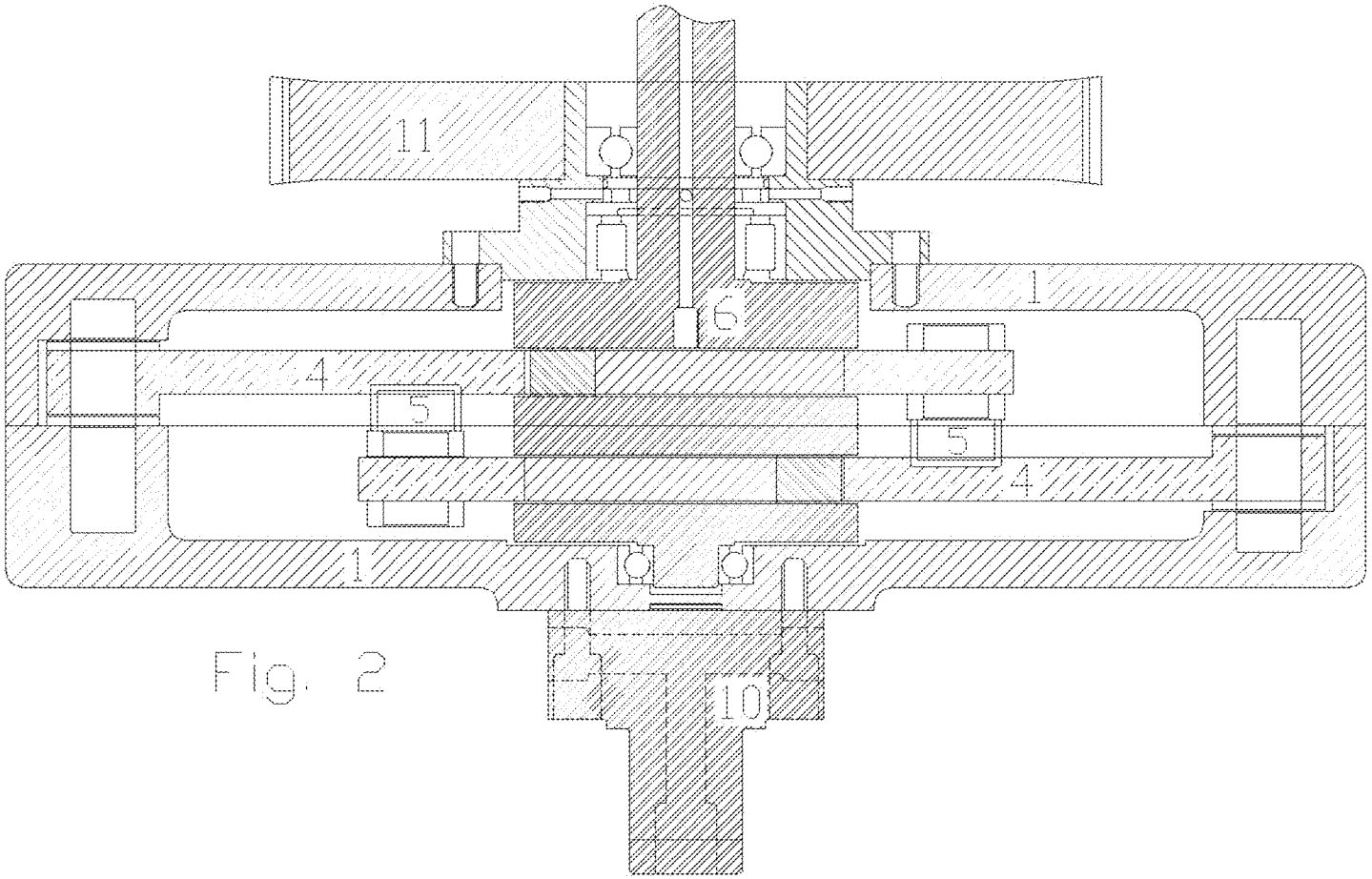
FIG. 2.—shows a section between the shafts (9) with the crankshaft being aligned with them.
Figure 3:
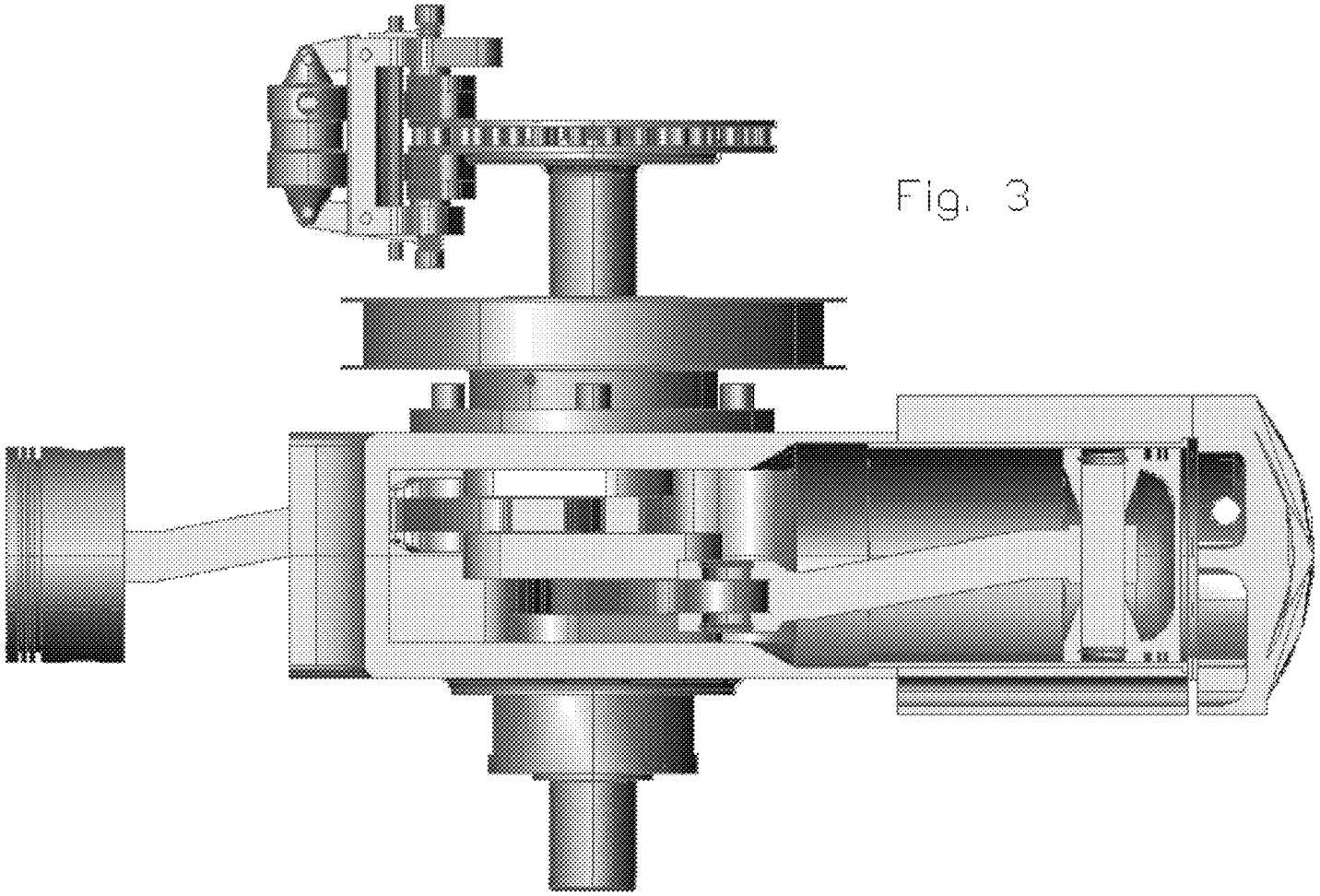
FIG. 3.—shows a section of a solid view where the inside of a cylinder and a braking mechanism coupled to the crankshaft can be seen.
Figure 4:
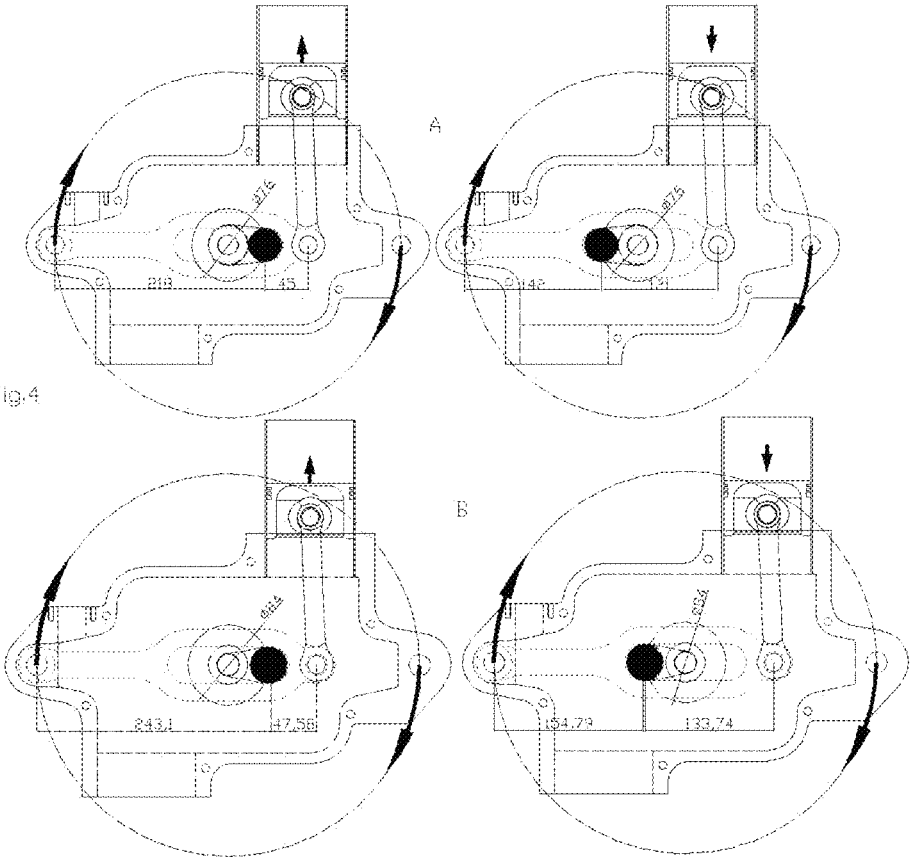
FIG. 4.—shows the improvement of the interrelation of the power-resistance arms with a slight diameter increase of the crankshaft.
Figure 5:
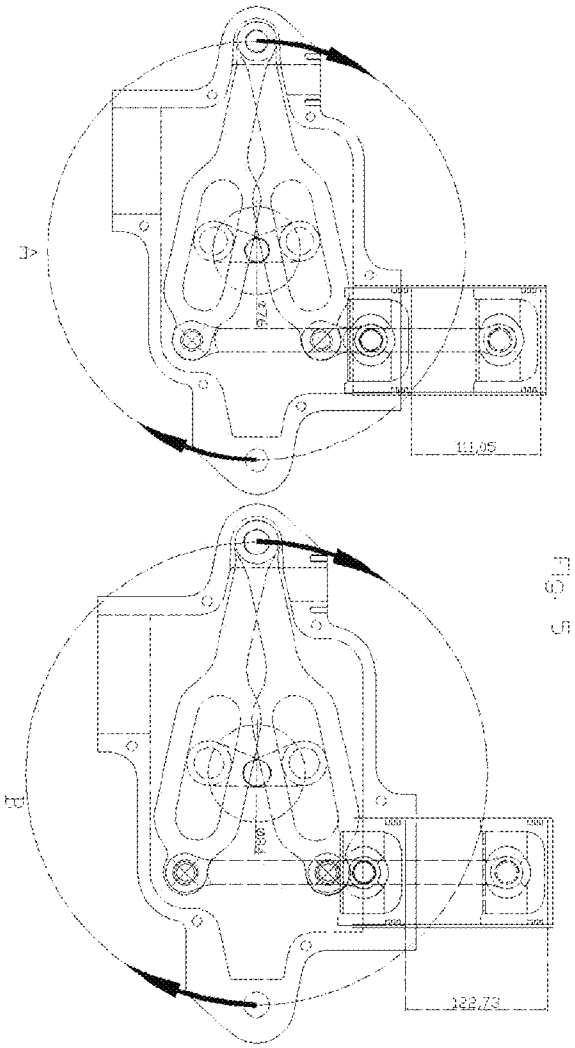
FIG. 5.—shows the extension in the piston stroke with a diameter increase of the crankshaft.
Figure 6:
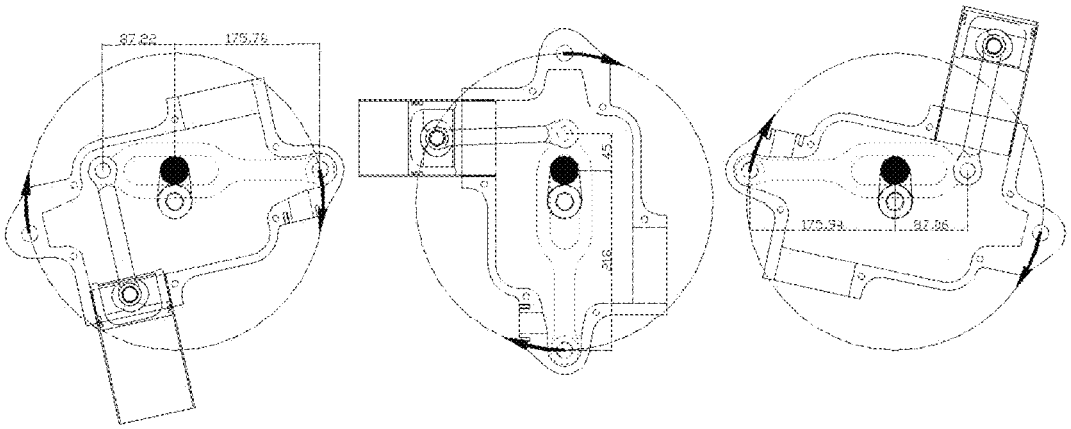
FIG. 6.—shows the variation in the lever arms during the assembly rotation.

In view of the figures and the above description, it does not seem necessary to make this descriptive specification more extensive so that a person skilled in the art can understand the scope of the same and the advantages arising from it.

What is claimed is:

1. A pump or rotary compressor assembly comprising:

a crankcase configured to rotate on a central shaft and provided with housings to couple two diametrically opposed cylinders, the crankcase including:

two shafts located within a peripheral area of the crankcase and opposite one another;

two levers each rotatingly connected at a first end to a respective shaft and including a connection point at a second end thereof and a slotted area disposed between the first end and the second end;

two connecting rods, each having a first end connected to a respective piston and a second end rotatingly connected to the second end of one of the respective levers;

two cylinders each to house a respective piston and including a cylinder head thereon and suction and discharge valves; and a crankshaft including a journal disposed at opposite ends thereof, each journal being disposed within a slotted area of a corresponding lever, the crankshaft remaining statically connected to a support and the entire assembly rotating on the support when a torque is applied to the crankcase to displace the journals within the slotted areas of the corresponding levers to displace a corresponding connecting rod such that one complete rotation of the crankcase causes a complete cycle of the pistons.

* * * * *